US006354551B1

(12) United States Patent
Oxley

(10) Patent No.: US 6,354,551 B1
(45) Date of Patent: Mar. 12, 2002

(54) THEATER SEATBACK CUP HOLDER

(75) Inventor: Catherine Young Oxley, Kansas City, MO (US)

(73) Assignee: Cy Young Industries, Inc., North Kansas City, MO (US)

( * ) Notice: Subject to any disclaimer, the term of this patent is extended or adjusted under 35 U.S.C. 154(b) by 0 days.

(21) Appl. No.: 09/657,558

(22) Filed: Sep. 8, 2000

(51) Int. Cl.[7] ..... A47K 1/08

(52) U.S. Cl. ..... 248/311.2; 297/188.18; 297/188.14

(58) Field of Search ..... 248/311.2, 311.3, 248/312.1, 314, 213.3, 218.4, 219.1, 684; 297/188.14, 188.18, 188.2

(56) References Cited

U.S. PATENT DOCUMENTS 3,913,878 A * 10/1975 Wayne ..... 248/311.2
4,262,962 A * 4/1981 Yust ..... 297/188.18
4,795,211 A * 1/1989 Stern et al. ..... 297/188.18
D307,852 S 5/1990 Clark ..... D7/620
D328,223 S 7/1992 Clark ..... D7/622
5,238,212 A * 8/1993 Dechellis ..... 248/311.2
5,395,085 A * 3/1995 Mann ..... 248/311.2
5,474,272 A * 12/1995 Thompson et al. ..... 348/311.2
5,533,782 A * 7/1996 Goldman ..... 297/188.18
5,813,644 A * 9/1998 Bergin ..... 248/311.2
6,227,511 B1 * 5/2001 De Costa ..... 248/311.2
D445,308 S * 7/2001 Oxley ..... D7/620

* cited by examiner

*Primary Examiner*—Ramon O Ramirez
*Assistant Examiner*—Holly N. Sy
(74) *Attorney, Agent, or Firm*—Wm. Bruce Day

(57) ABSTRACT

A cup holder assembly is mounted to a chair arm of the type having a T-shaped arm. The cup holder assembly comprises a cup holder body having an open-top receptacle for receiving a beverage cup, a lower leg extending from the body for support against a chair arm stanchion and a bracket having a clip portion to grip the chair T-shaped arm and an upstanding leg. The bracket is connected to the cup holder body by a fastener to mount the cup holder body to the chair arm. A bracket cover conceals the bracket.

3 Claims, 2 Drawing Sheets

THEATER SEATBACK CUP HOLDER

FIELD OF THE INVENTION

This invention relates to cup holders for attachment to theater or stadium seats, and in particular, to a cup holder that is attachable to the back of the seat.

BACKGROUND OF THE INVENTION

Various types of cup holders which attach to the armrests of theater and stadium seats have been known for many years. These are particularly popular in movie theaters to enable theater patrons to buy large containers of soft drinks, popcorn or the like. It is well known that movie theater operators receive significant revenue from concession sales, employment of theater seat cup holders facilitates the sale of concession goods by providing a handy, non-spill holder for the purchased goods. The same is true for sports stadium seats, for during the course of a football or baseball game, the patron may consume several beverage servings. Drink cup holders, either mounted on the back of the seat in front or mounted on the armrest facilitate concession sales and also help in maintaining a clean stadium, as drinks put down on the floor are too often knocked over, particularly as sports fans jump to their feet during game highlights. There are several types of theater seatback cup holders available, but all require drilling into the seatback to attach a screw and many are weakly connected. Patrons often lean back in their seats and push against or rest their legs on seatback cup holders, and so if there is any weakness in the attachment, instability is soon apparent, and the cup holders may eventually tear loose from the seatbacks.

Applicant's disclosed and claimed theater seatback cup holder does not require drilling into the seatback for attachment, and thereby provides a major advantage over prior cup holders. The disclosed cup holder merely clamps to the chair arm between the seats and extends rearwardly with portions bearing against the seatbacks to provide stability. A bracket cover conceals the mounting connection and provides a finished appearance. Applicant's seatback cup holder may include suitable advertising slogans or logos of sponsors, such as soft drink or beer suppliers. Many stadium operators have found that cup holder armrests pay for themselves over a relatively short period of time in increased beverage sales and decreased cleanup costs. Particularly when the cost of purchase and installation is defrayed or picked up entirely by beverage companies, there is little reason not to purchase and install these cup holders.

DESCRIPTION OF THE PREFERRED AND ALTERNATE EMBODIMENTS

As required, detailed embodiments of the invention are disclosed herein, however, the invention may be embodied in various forms and differing arrangements and configuration of parts.

Figure 1:
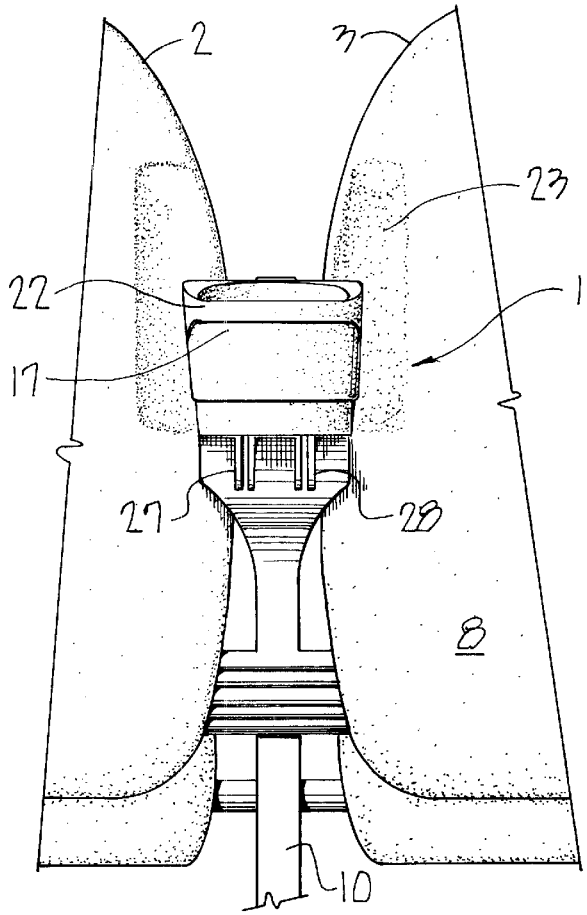
FIG. 1 is an elevational view of adjoining portions of theater seatbacks and showing a seatback cup holder embodying the present invention connected thereto.
Figure 2:
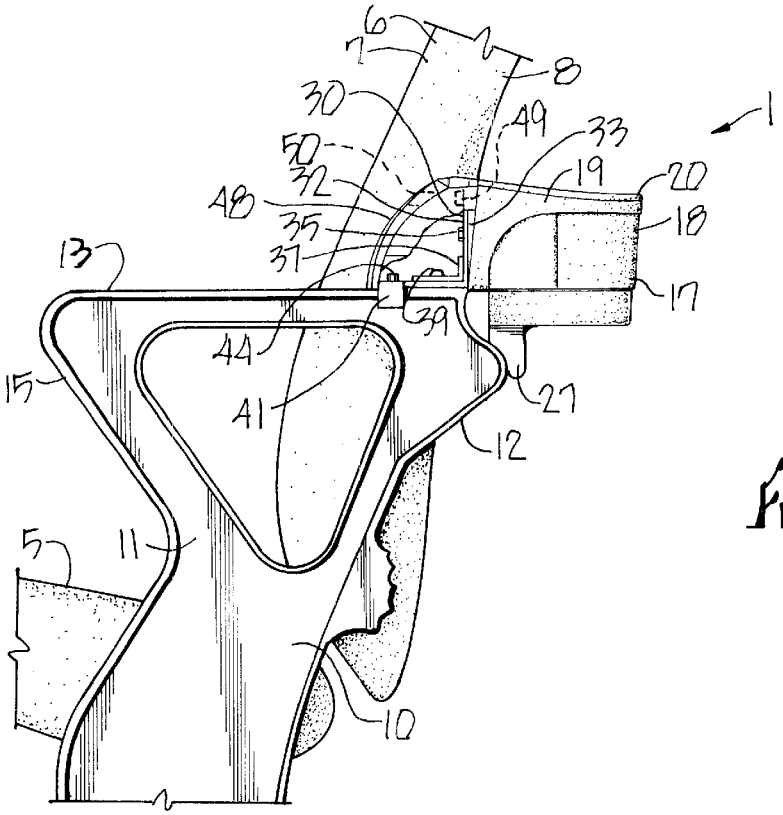
FIG. 2 is a side elevational view of the seatback cup holder mounted to a theater seat.
Figure 3:
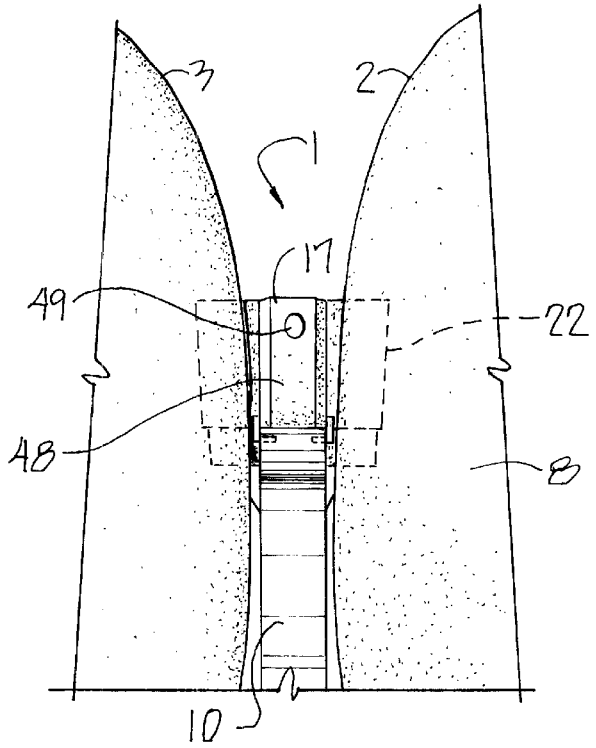
FIG. 3 is a front elevational view, taken from the front of the seat showing the seatback cup holder mounted.

The reference 1, FIG. 1 identifies a cup holder assembly which is mountable to and between spaced theater seats 2 and 3. As used herein, the term theater seat means both seats used for plays, movies and other such typically indoor facilities, as well as sports stadia such as for football, basketball or baseball games, which may be either outdoors or indoors. The typical theater seat 2 or 3 includes a foldable seat bottom 5 and a back 6, the back 6 having forward and rearward facing surfaces 7 and 8. The seats are supported by stanchions 10 which consists of an upright portion 11, a back brace portion 12 and an armrest portion 13 which is generally T-shaped in cross-section. The margins of the stanchion 10 are generally formed in a right angle surrounding flange 15. The flange 15 at the armrest 13 is particularly broad to form a wide area to comfortably rest a person's arm. The extra width carries through into the back brace portion 12 whereupon the flange 15 narrows again. The particular stanchion shown is from the medallion (TM) chair of the Hussey Seating Company and is a popular theater or stadium seating chair. Although the configuration of the illustrated cup holder assembly has been selected to accord to the Hussey Medallion chair, the cup holder assembly may be used with other stadium seats from other manufacturers, with slight changes in model configuration.

The cup holder assembly 1 has a cup holder body 17 of tough synthetic material including a cylindrical sidewall 18 with a decorative faring 19 and lip 20. Opposite wings 22 extend outwardly from the body 17 and are configured for surface engagement with recesses 23 in the rearward facing surface 8 of the seatback 6.

Figure 4:
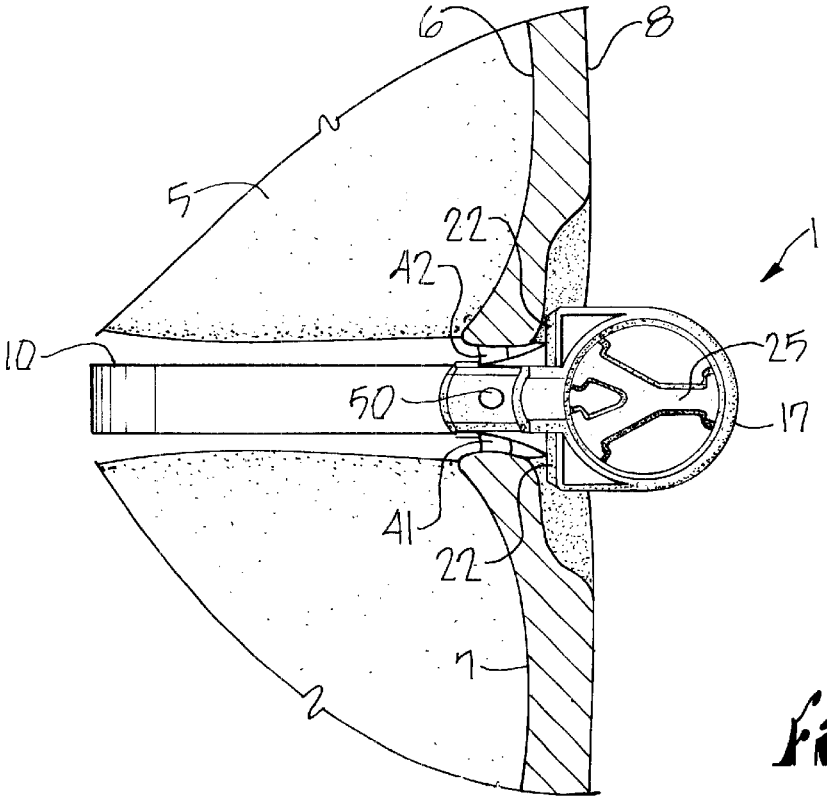
FIG. 4. is a top plan view of the seatback cup holder.

To close the bottom of the cup holder body 17, a bottom web 25 extends there across. In the illustrated example, FIG. 4, the bottom web 25 is of a ornamental Y-shape, although other shapes may be used as desired. For example, the Y-shape could be used in a baseball Yankee's stadium. At least one lower leg, and in the illustrated example, lower legs 27 and 28 extend downwardly from the lower end of the cup holder body 17 and brace against suitable areas of the stanchion 10. In the illustrated example, the lower legs 27 and 28 have arcuate tips which mate with the curved adjoining portion of the back brace portion 12.

The cup holder assembly 1 is connected to the stanchion 10 by a bracket 30. The bracket 30 is L-shaped of metal, right angled and has an upstanding leg 32 which is fastened to a mating face 33 of the body 17 as by the fastener 35. A doubler 37 or other strengthening aid strengthens the bracket 30 at its corner. A horizontal leg 39 of the bracket 30 extends forwardly and terminates in oppositely extending U-shaped clips 41 and 42 which bend under the broadened flange of the stanchion armrest portion 13. The configuration of the armrest of the Hussey Medallion chair is such that the armrest flange gradually tapers and the bracket 30 is able to be slid onto the tapering armrest. The bracket 30, as aforestated, is secured to the cup holder body 17 at the bracket upstanding leg 32 by the fastener 35. The cup holder body 17 is secured to the stanchion 10 by the U-shaped clips 41 and 42 of the bracket horizontal leg 39 and a fastener 44 extends downwardly through the horizontal leg and bears upon the upper surface of the stanchion armrest portion 13. The fastener 44 is in the nature of a set screw, as it is not necessary to penetrate into the stanchion 10. Upon tightening, the fastener set screw 44 pulls the clips 41 and 42 up tightly to prevent horizontal sliding.

Finally, the bracket 30 is concealed by a cover 48 which is curved in an ornamental appearance to accord with the curvature of the faring 19. The cover 48 is held in place by a fastener 49 which is accessible through a access bore 50 through the cover 48.

Although the cup holder assembly 1 has been illustrated and described in connection with the Hussey Medallion™ chair, it may be of other configurations to accord with other designs of stadium seating. Additionally, the cup holder assembly 1 may have other ornamental features apart from the ones described and shown herein. Although the invention has been illustrated and described in the singular embodiment, it is not to be so limited as other configurations may be accommodated within the following claims.

What is claimed and desired to be protected by Letters Patent is:

1. A cup holder assembly mountable to a chair arm of the type having a T-shaped arm and comprising:

a) a cup holder body having an open top receptacle for receiving a beverage cup;

b) a lower leg extending from the body for support against a chair arm stanchion;

c) a bracket having a clip portion for gripping the chair T-shaped arm and an upstanding leg, the bracket connected to said cup holder body by a fastener to mount said cup holder body to the chair arm; and d) a bracket cover concealing said bracket.

2. The cup holder assembly set forth in claim 1 wherein said clip portion has U-shaped clips for gripping the T-shaped arm and a set screw which bears against a top surface of the T-shaped arm.

3. A seatback cup holder comprising:

a) a cup holder body having an open top receptacle for receiving a beverage cup;

b) wings extending outwardly from said body for surface contact with adjoining seatbacks;

c) a lower leg extending from said body for supportive engagement against a chair arm stanchion;

d) a generally L-shaped bracket having a clip portion for gripping a chair T-shaped arm and an upstanding leg, the bracket connected to said cup holder body by a fastener for mounting the cup holder body to the chair arm between and in contact with said adjoining seatbacks; and e) a bracket cover concealing said bracket.

* * * * *